US008988164B2

(12) United States Patent
Arnold et al.

(10) Patent No.: US 8,988,164 B2
(45) Date of Patent: Mar. 24, 2015

(54) WAVEGUIDE BUSBAR

(71) Applicant: Tesat-Spacecom GmbH & Co. KG, Backnang (DE)

(72) Inventors: Christian Arnold, Bietigheim-Bissingen (DE); Jean Parlebas, Burgstetten (DE); Daniel Reicherter, Stuttgart (DE)

(73) Assignee: Tesat-Spacecom GmbH & Co. KG, Backnang (DE)

( * ) Notice: Subject to any disclaimer, the term of this patent is extended or adjusted under 35 U.S.C. 154(b) by 99 days.

(21) Appl. No.: 13/917,738

(22) Filed: Jun. 14, 2013

(65) Prior Publication Data

US 2013/0335165 A1 Dec. 19, 2013

(30) Foreign Application Priority Data

Jun. 15, 2012 (DE) ..... 10 2012 011 765

(51) Int. Cl.

| | |
|---|---|
| ***H01P 5/12*** | (2006.01) |
| ***H01P 1/20*** | (2006.01) |
| ***H01P 1/208*** | (2006.01) |
| ***H01P 1/30*** | (2006.01) |
| ***H01P 7/06*** | (2006.01) |

(52) U.S. Cl.

CPC *H01P 1/20* (2013.01); *H01P 1/208* (2013.01); *H01P 1/30* (2013.01); *H01P 5/12* (2013.01); *H01P 7/06* (2013.01)

USPC ..... 333/135; 333/229; 333/234

(58) Field of Classification Search

USPC ..... 333/135, 137, 219, 227, 229, 231–234

See application file for complete search history.

(56) References Cited

U.S. PATENT DOCUMENTS

| | | | | |
|---|---|---|---|---|
| 3,428,918 | A | 2/1969 | Matthaei | |
| 3,614,518 | A * | 10/1971 | Schmidt | 315/5.53 |
| 5,949,309 | A * | 9/1999 | Correa | 333/202 |
| 6,246,727 | B1 | 6/2001 | Larsson et al. | |
| 2006/0038640 | A1 | 2/2006 | D'Ostilio | |
| 2011/0058809 | A1 | 3/2011 | Lagorsse et al. | |

FOREIGN PATENT DOCUMENTS

DE 10 2010 044 267 A1 5/2011

* cited by examiner

*Primary Examiner* — William Hernandez

(74) *Attorney, Agent, or Firm* — Crowell & Moring LLP

(57) ABSTRACT

A waveguide busbar for converting a plurality of high-frequency input signals into high-frequency output signals, includes a waveguide, a plurality of input ports, which are arranged along the waveguide, such that each input port is intended to receive a high-frequency input signal, an output port on the waveguide for delivering the high-frequency output signal and at least one parallel resonator, which is connected to the waveguide busbar between two input ports. The parallel resonator has a mechanically adjustable volume with which a phase relation of the waveguide is adjustable between the two input ports.

15 Claims, 5 Drawing Sheets

WAVEGUIDE BUSBAR

CROSS-REFERENCE TO RELATED APPLICATIONS

The present application claims priority to German Patent Application No. 10 2012 011 765.5, filed Jun. 15, 2012, the entire disclosure of which is herein expressly incorporated by reference.

BACKGROUND AND SUMMARY OF THE INVENTION

Exemplary embodiments of the present invention relate to temperature compensation of waveguide busbars for use, for example, in output multiplexers and/or in a communication satellite. Exemplary embodiments of the present invention also relate to a waveguide busbar having adjustable phase relations.

A typical output multiplexer consists of channel filters connected to a waveguide busbar. The high-frequency signals output by the channel filters are combined in the waveguide busbar and output as output signals at one end of the waveguide busbar.

The waveguide busbar is normally designed so that there is the least possible interfering interaction between the channel filters. The phase lengths between the individual channels filters on the busbar and the phase lengths between the busbar and the channel filters are therefore optimized during development to prevent any mutual influence on the channel filters.

To ensure good thermal conductivity of the busbar and to minimize thermomechanical problems due to the differences in expansion coefficients of the waveguide busbar and an aluminum base plate, the waveguide busbar is usually also made of aluminum. This also leads to a comparatively lightweight waveguide busbar.

However, due to the relatively high thermal expansion coefficient of aluminum, unwanted changes in phase relations occur in the waveguide busbar during temperature fluctuations. This leads to a degradation of filter parameters, which is even worse, the greater the length of the waveguide busbar and the greater the deviation from the temperature for which the waveguide busbar was designed. Consequently, this degradation is especially critical for multiplexers with a high power and a high channel count, because they combine long waveguide busbars and high temperatures.

A conventional approach uses Invar bolts in the Ku strip (at 10.7-12.7 GHz), which reduce the a-dimension (i.e., the dimension in a first width direction) of the waveguide busbar with the help of an aluminum fin. Since the a-dimension of the waveguide determines the wavelengths of the waveguide in the H10 mode, compensation of the phase relations may be achieved within certain limits by reducing the a-dimension.

However, this method is not usually very suitable for frequencies higher than 13 GHz. First, the b-dimension (i.e., the dimension in a second width direction) of the waveguide busbar is much smaller. Therefore, the stiffness of the waveguide busbar increases greatly and deformation becomes much more difficult. Second, the channel spacing in relation to the wavelength in the Ka band (at 26.5-40 GHz) is much greater than in the Ku band because the minimum distances are much greater due to the manufacturability in the Ka band. The same thing also applies to milled half-shell waveguide busbars in which the half-shell flange provides reinforcement of the waveguide busbar, so that compensation with Invar clamps is impossible.

Exemplary embodiments of the present invention are directed to a waveguide busbar whose phase relations between the input ports are easily adjustable. Exemplary embodiments of the present invention also reduce temperature-related fluctuations in the phase relations in a hollow care busbar.

One aspect of the present invention relates to a waveguide busbar for converting a plurality of high-frequency input signals to a high-frequency output signal. Such a waveguide busbar may be used in a multiplexer, for example, to combine the signals of a plurality of channel filters into one output signal.

According to one specific embodiment of the invention, the waveguide busbar comprises a waveguide, a plurality of input ports arranged along the waveguide, such that each input port is intended for receiving a high-frequency input signal, and an output port at the end of the waveguide for delivering the high-frequency output signal.

The waveguide may be, for example, a square waveguide, i.e., a tube having a rectangular profile. Other cross sections and profiles are also possible, such as a circular or rounded profile. The waveguide may be made of a metal, such as, for example, aluminum.

In accordance with one aspect of the invention, channel filters of a multiplexer may be connected to the input ports.

The waveguide busbar also comprises at least one parallel resonator connected to the waveguide busbar. The parallel resonator has a mechanically adjustable (resonant) volume with which a phase relation of the waveguide between the two input ports can be adjusted.

In other words, adjustable parallel resonators may be placed along the waveguide busbar and may be adjusted in their geometry and/or their volume based on the temperature and/or to adjust the phase relations of the waveguide busbar.

The phase relation of a high-frequency signal conducted from the waveguide between the two input ports may be adjusted with the parallel resonator. The parallel resonator forms a parallel dummy element (having a parallel inductance and/or parallel capacitance, depending on the resonant frequency) in the pass band of the filter and/or the waveguide busbar. This influences the phase in the waveguide section in which it is located. If the volume of the parallel resonator is altered, its capacitance and/or inductance will also change, resulting in a difference in the phase relation between the ends of the waveguide section to which the parallel resonator is connected.

The temperature drift of a waveguide busbar can thus be compensated with the parallel resonators as compensation resonators mounted along the waveguide. The phase lengths of the busbar can be kept constant in this way.

It is also possible for the waveguide busbar to be used by suitable adjustment mechanisms and/or actuators for adjustable phase relations, for example, as an alternative, to be able to set the phase relation between two input ports at multiple predetermined values.

According to one specific embodiment of the invention, the parallel resonator comprises an actuator that changes the volume of the parallel resonator. For example, a length of the resonant volume of the parallel resonator can be altered with the actuator, a valve in the resonant volume can be opened and closed or a slide valve in the resonant volume may be shifted.

According to one specific embodiment of the invention, the actuator comprises a thermomechanical actuator. A thermomechanical actuator may be an actuator that changes its mechanical properties directly as a function of a change in temperature, for example, by expanding, curving or lengthening. For example, the thermomechanical actuator may be made of a bimetal and/or Invar. Those skilled in the art will recognize that Invar is a nickel iron alloy notable for its uniquely low coefficient of thermal expansion.

According to one specific embodiment of the invention, the thermomechanical actuator is adjusted for altering the volume of the parallel resonator, so that a change in the phase relation of the waveguide (between the two input ports and/or the waveguide section between the two input ports) is reduced or balanced by the parallel resonator, based on an extension of the waveguide due to a change in temperature. The change (for example, extension or lengthening) of the thermomechanical actuator created by a change in temperature is used to increase or decrease the volume of the parallel resonator accordingly.

According to one specific embodiment of the invention, the actuator comprises an electromechanical actuator. It is also possible for the change in volume to be accomplished with a stepping motor, a dc current motor and/or a piezo element, for example.

According to one specific embodiment of the invention, the waveguide busbar comprises an electronic controller, which is designed to control the electromagnetic actuator in such a way that a change in the phase relation of the waveguide (between the two input ports) due to an expansion of the waveguide caused by a change in temperature is reduced or compensated by the parallel resonator. The change in volume of the parallel resonator may also be adjusted indirectly (i.e., by measurement of the temperature and a subsequent determination of the corresponding resonant volume). The waveguide busbar may additionally comprise a temperature sensor with which the controller can ascertain the current temperature of the waveguide.

There are various options for the design of the parallel resonator. Fundamentally, the parallel resonator comprises a container, i.e., a hollow body that surrounds the resonant volume and is connected by a port to the waveguide. The volume of the parallel resonator (i.e., its resonant volume), which is connected to the waveguide can be altered by a mechanically generated change in the container (lengthening, closing and opening a valve, displacement of a slide).

According to one specific embodiment of the invention, the parallel resonator has a resonant volume that is variable in length. The container surrounding the resonant volume may be cylindrical, for example, and may have a rectangular or round profile. A barrel-shaped container is also possible. A telescoping mechanism or bellows may also be used to adjust the volume of the container.

The parallel resonator may thus be designed to be coupled both at the side and also at the end face. The coupling to the parallel resonators may be accomplished directly or via an input aperture.

According to one specific embodiment of the invention, the parallel resonator comprises a mobile slide element in a hollow cavity. The parallel resonator may have a cylindrical design or may have a flap which changes the volume of the parallel resonator in different positions.

According to one specific embodiment of the invention, the waveguide busbar comprises a plurality of parallel resonators.

If the parallel resonators are shortened in length through suitable measures (e.g., with the help of bimetals, Invar rods or bellows) as a function of the temperature, then they form parallel dummy elements, which are distributed along their waveguide busbar and can be used to adjust the phase given a suitable choice of the parameters. A temperature-compensated waveguide busbar can be implemented in this way.

If the parallel resonators are moved with the help of electromechanical actuators, an adjustable busbar can also be implemented, the phase relations between the channel filters being adjustable thereby when the channel filters are adjusted in their center frequency or bandwidth. A phase-adjustable waveguide busbar is then implementable in this way.

According to one specific embodiment of the invention, at least one parallel resonator is connected to the waveguide between two input ports. Each waveguide section between the neighboring input ports may be connected to one or more parallel resonators.

According to one specific embodiment of the invention, at least two parallel resonators are connected to the waveguide between two neighboring input ports. For example, different relations for a waveguide section may be created using parallel resonators having a similar or identical design.

According to one specific embodiment of the invention, the waveguide busbar additionally comprises a plurality of connection pieces connected to the input ports. For example, further tubes (e.g., rectangular tubes) that may be connected to the waveguide via a channel filter may also be mounted on the waveguide.

According to one specific embodiment of the invention, the phase lengths of the waveguide sections between the input ports and/or the phase lengths of the connection pieces are adjusted to predefined frequency ranges of the high-frequency input signal. The phase lengths of the waveguide between the input ports may have different values. The phase lengths of the connection pieces may have different values.

According to one specific embodiment of the invention, a resonant range of the parallel resonator is tuned to a pass band of the waveguide busbar. The resonant range of the parallel resonator may be above or below the pass band, for example.

The parallel resonators may be adjusted (structurally) so that the resonant frequency is beyond the filter pass band. The parallel resonators may thus be of such dimensions that their resonant frequency is far beyond the pass band of the multiplexer, so as not to increase the multiplexer losses.

Another aspect of the invention relates to an output multiplexer, which comprises a waveguide busbar, as described above and below.

According to one specific embodiment of the invention, the output multiplexer comprises a plurality of channel filters, which are each connected to an input port of the waveguide busbar, for example, via connecting pieces.

Another aspect of the invention relates to the use of a waveguide busbar as described above and below in an output multiplexer of a communication satellite.

Such a multiplexer may be used in a satellite, for example. The satellite receives a complex signal that is broken down into bands that are amplified. The amplified signals of the bands are filtered with the channel filters of the multiplexer and then combined via the waveguide busbar to form an output signal, which is sent by the satellite.

BRIEF DESCRIPTION OF THE DRAWING FIGURES

Exemplary embodiments of the invention are described in detail below with reference to the accompanying figures.

Identical or similar parts are basically provided with the same reference numerals.

DETAILED DESCRIPTION

Figure 1:
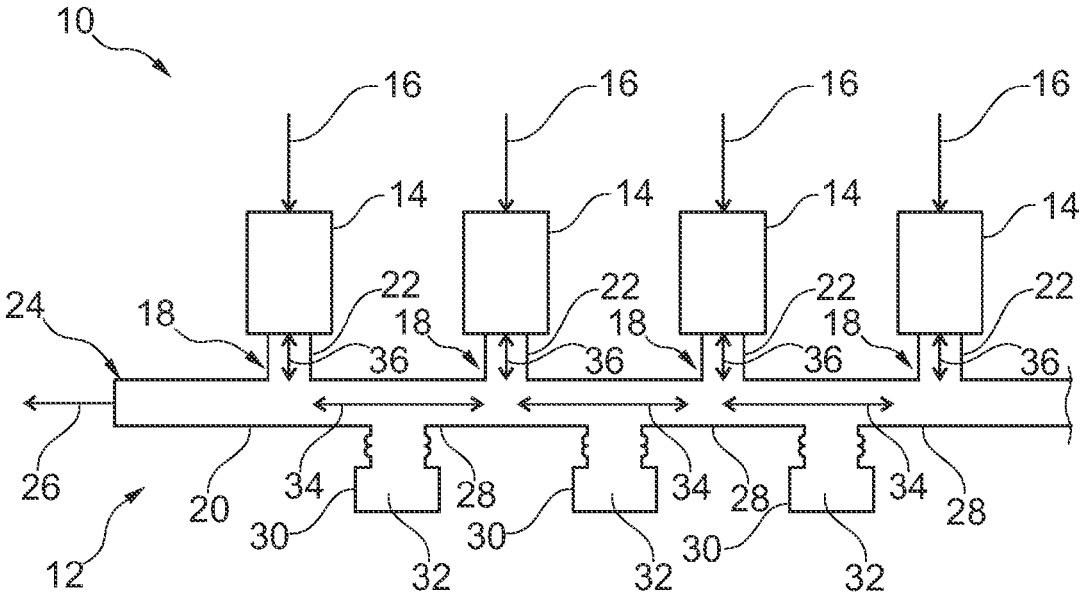
FIG. 1 shows a schematic cross section through a multiplexer according to one specific embodiment of the invention.

FIG. 1 shows an output multiplexer 10, which includes a waveguide busbar 12 and a plurality of channel filters 14. High-frequency signals 16 are filtered through the channel filter 14 and are introduced into the waveguide busbar 12 via input ports 18.

The waveguide busbar 12 comprises a waveguide 20, which has input ports 18 along its direction of extent, these ports being formed in its wall. Connecting pieces 22, which connect the corresponding channel filter 14 to the respective input port 18, are situated between the channel filters 14 and the input ports 18.

The high-frequency signals 16 generated by the filters travel through the connection pieces 22 and are superimposed on the waveguide 20 and relayed to an output port 24 at the end of the waveguide 20, where an output signal 26 is leaving the waveguide busbar 12.

On each waveguide section 28, each being connected to two neighboring input ports 18, a parallel resonator 30 having a variable volume 32, as indicated by the bellows, is mounted on the waveguide 20.

The phase length 34 of the waveguide section 28 and the phase length 36 of the connecting pieces 22 are set at a predefined position of the parallel resonators 30, such that any mutual influence on the channel filters 14 is minor and the damping of the waveguide busbar 12 is minimal.

The phase length 34 of a waveguide section 28 and/or the phase relation between the two input ports 18 at the ends of the waveguide section 28 can be varied and adjusted by varying the resonant volume 32 of the corresponding parallel resonator 30.

In particular, when there is a change in temperature in the environment of the waveguide busbar 12, the material of the waveguide 20 may expand or shrink, thereby altering the geometric length of the waveguide sections 28 and thus also their phase lengths 34. Precisely this change in phase length can be compensated through an appropriate change in resonant volume 32. As described further below with respect to FIGS. 3A through 3C, this can be accomplished either directly by means of a thermomechanical actuator or indirectly by means of an electromechanical actuator.

It is also possible to adjust the phase length 34 of a waveguide section 28 during operation, for example, to adjust the waveguide busbar 12 to altered filter parameters.

Figure 2:
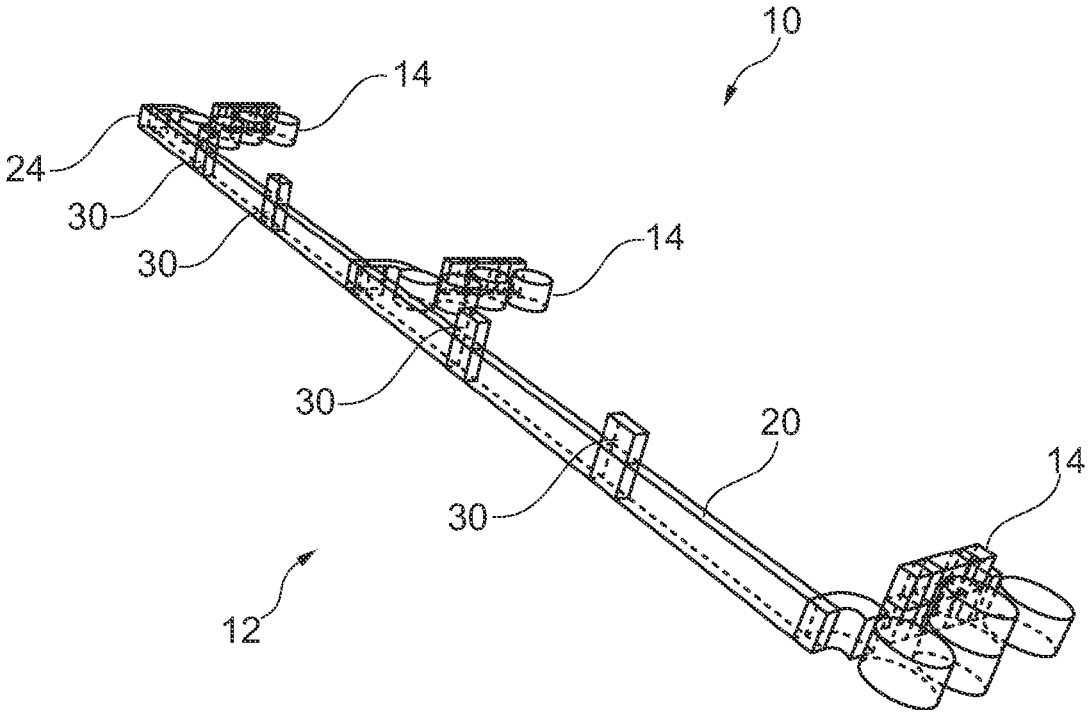
FIG. 2 shows a schematic three-dimensional view of a multiplexer according to another specific embodiment of the invention.

FIG. 2 shows an output multiplexer 10 comprising two parallel resonators 30 between two neighboring channel filters 14. As shown in FIG. 2, the waveguide 20 may have a rectangular profile.

The parallel resonators 30 may protrude away from the waveguide 20 in the same direction or in a different direction like channel filter 14 and/or like connecting pieces 22, for example, on the opposite side (FIG. 1) or at right angles to one another (FIG. 2).

Figure 3A:
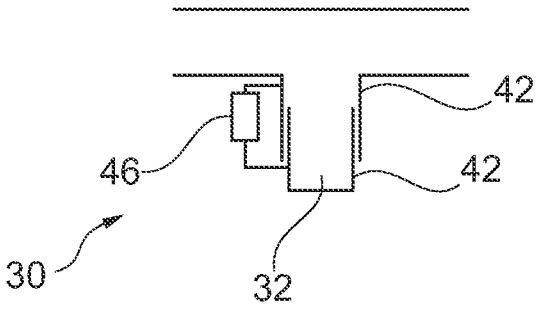
FIG. 3A shows a schematic cross section through a parallel resonator according to one specific embodiment of the invention.

FIG. 3A shows a parallel resonator 30 having a cylindrical resonant volume. The parallel resonator 30 comprises two pipes 42 which can be pushed into one another, thus being able to change their length like a telescope.

The length of the resonant volume 32 can be adjusted with an actuator 46, which may be a thermomechanical actuator. A thermomechanical actuator 46 comprises, for example, a bimetal, which changes the length of the actuator 46 as a function of the ambient temperature. The change in length of the actuator 46 and the change in volume of the resonant volume 32 may be coordinated structurally with one another so that the temperature-related change in length of the actuator 46 and the associated change in volume of the volume 32 compensate for a change in phase length due to the extension of the waveguide section 28.

Figure 3B:
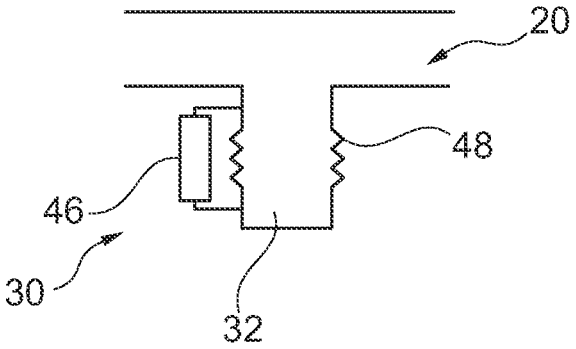
FIG. 3B shows a schematic cross section through a parallel resonator according to another specific embodiment of the invention.

FIG. 3B shows another parallel resonator 30 comprising bellows 48 in contrast with FIG. 3A.

Figure 3C:
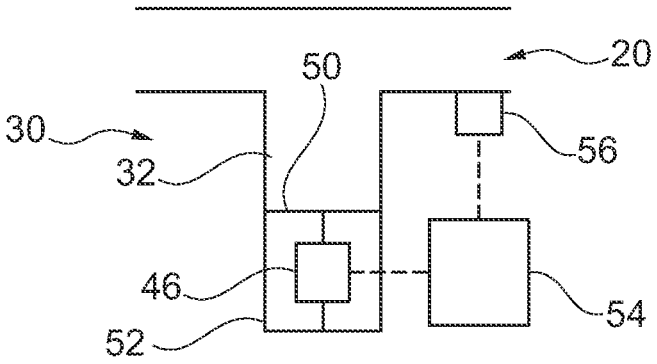
FIG. 3C shows a schematic cross section through a parallel resonator according to another specific embodiment of the invention.

FIG. 3C shows a parallel resonator 30 having a cylindrical design. A slide element 50 in a hollow body 52 may be displaced by an actuator 46 to thereby alter the resonant volume 32. The actuator 46 may comprise a thermomechanical actuator as shown in FIGS. 3A and 3B.

It is also possible for the actuator 46 to comprise an electromechanical actuator such as, for example, an electric motor or a piezo element. The electromechanical actuator 46 can be controlled via, for example, a controller 54. If a temperature-dependent control is desired, the waveguide busbar 12 may comprise a temperature sensor 56 by which the controller 54 can detect the temperature of the waveguide rail 20.

To compensate for a temperature-induced phase shift, the control may then, for example, use a table to determine the required position of the actuator 46 at a certain temperature.

Figure 4A:
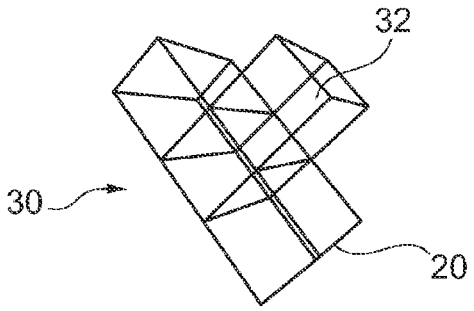
FIG. 4A shows a schematic three-dimensional view of a parallel resonator according to another specific embodiment of the invention.

FIG. 4A shows a parallel resonator 30, for which it was calculated that shortening the resonant volume length from 8 mm to 7.65 mm can compensate for a phase shift in a waveguide section 28 that is exposed to a temperature difference of 100° C. In this case the phase relation between the ports 18 may vary between 68.426° and 66.759°, which can be compensated by the aforementioned change in the resonant volume.

Figure 4B:
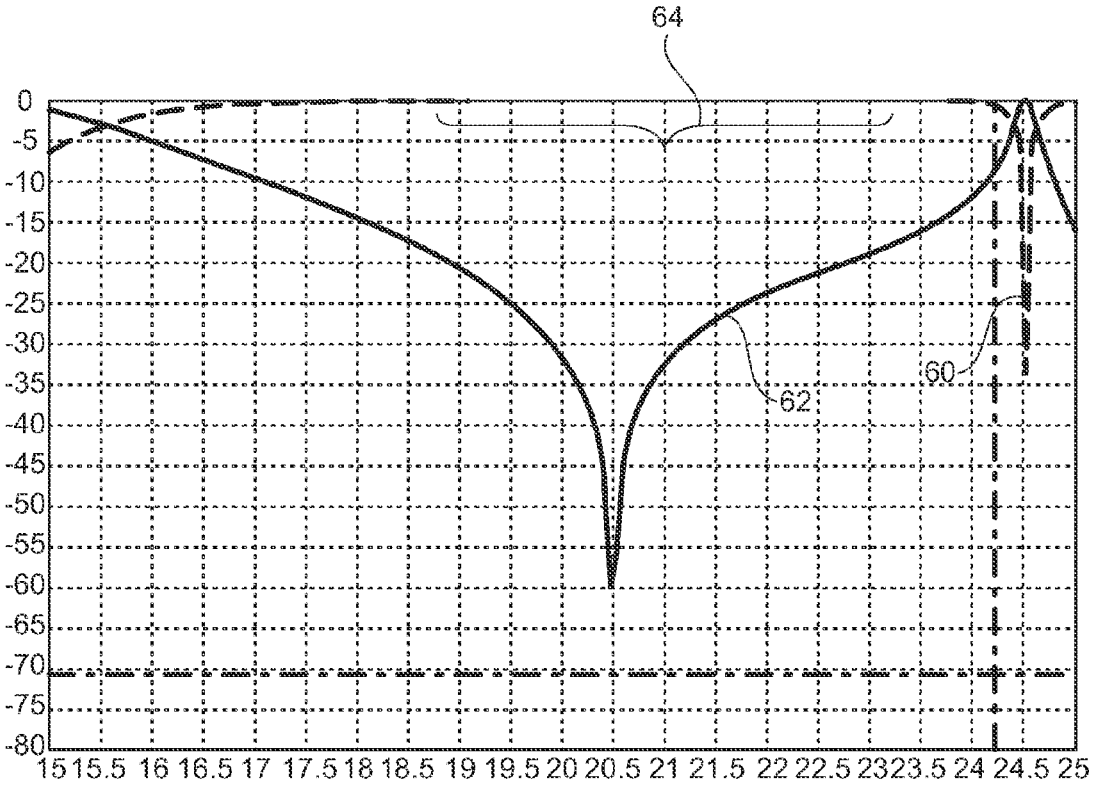
FIG. 4B shows a diagram of the resonant behavior of the parallel resonator from FIG. 4A.

FIG. 4B shows a diagram with the resonant behavior of the parallel resonator 30 from FIG. 4A. The damping in dB is plotted vertically and the frequency in GHz is plotted horizontally. The curve 60 shows the resonance of the parallel resonator 30 whose resonant frequency is approximately 24.5 GHz. The curve 62 shows its reflection characteristic, which is minimal at approximately 20.5 GHz.

The possible pass band 64 of the multiplexer 10 may be between approximately 18 GHz and 23 GHz, for example, where the reflection is as low as possible and there are no losses due to resonance. The resonant frequency of the parallel resonator 30 is above the pass band.

Figure 5A:
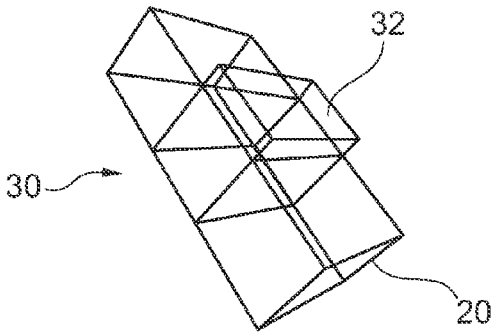
FIG. 5A shows a schematic three-dimensional view of a parallel resonator according to another specific embodiment of the invention.

FIG. 5A shows a parallel resonator 30 like that in FIG. 4A with a shorter resonant volume 32. As in FIG. 4A, a change in the resonant volume length between 1.9 mm and 2 mm may compensate for a change in the phase relation between 98.398° and 96.644° created due to a temperature difference of 100° C.

Figure 5B:
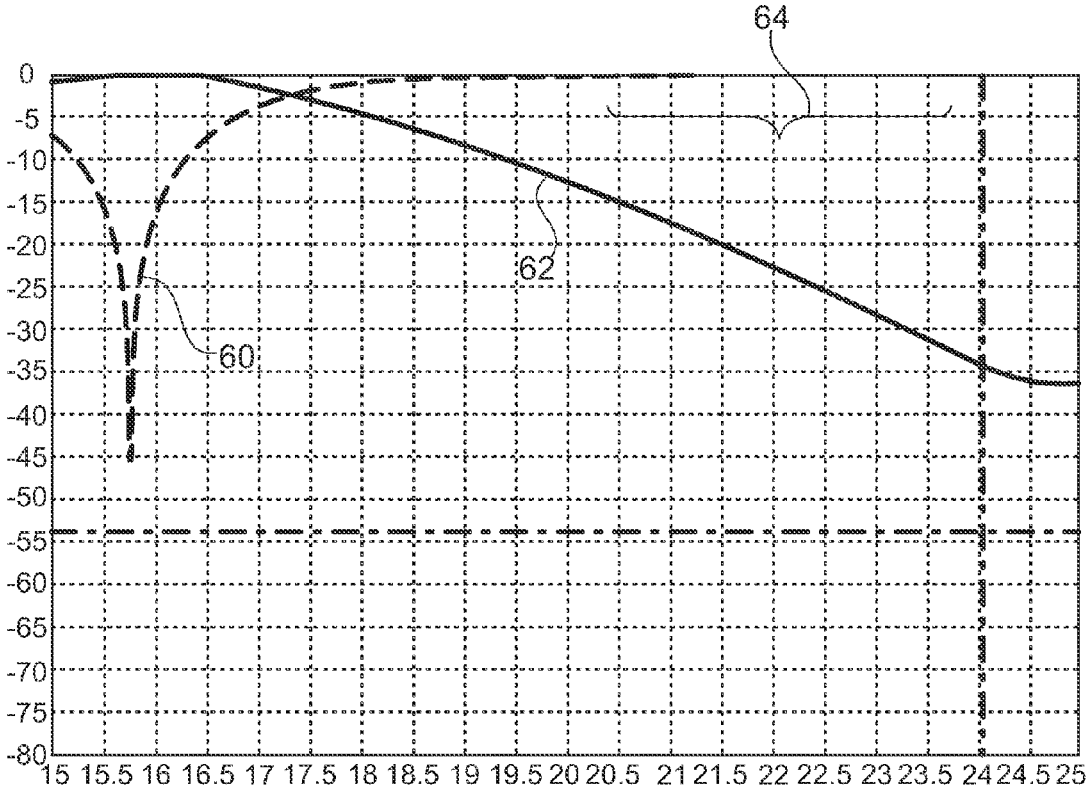
FIG. 5B shows a diagram of the resonant behavior of the parallel resonator from FIG. 4A.

FIG. 5B shows a diagram like that in FIG. 4B, but for curves 60, 62 for the parallel resonator 30 from FIG. 5A. The resonant frequency of the parallel resonator 30 is approximately 15.75 GHz and the minimum reflection is approximately 24.5. The possible pass band 64 of the multiplexer 10 can then be between approximately 20 GHz and 25 GHz, for example. The resonant frequency of the parallel resonator 30 is below the pass band.

Figure 6:
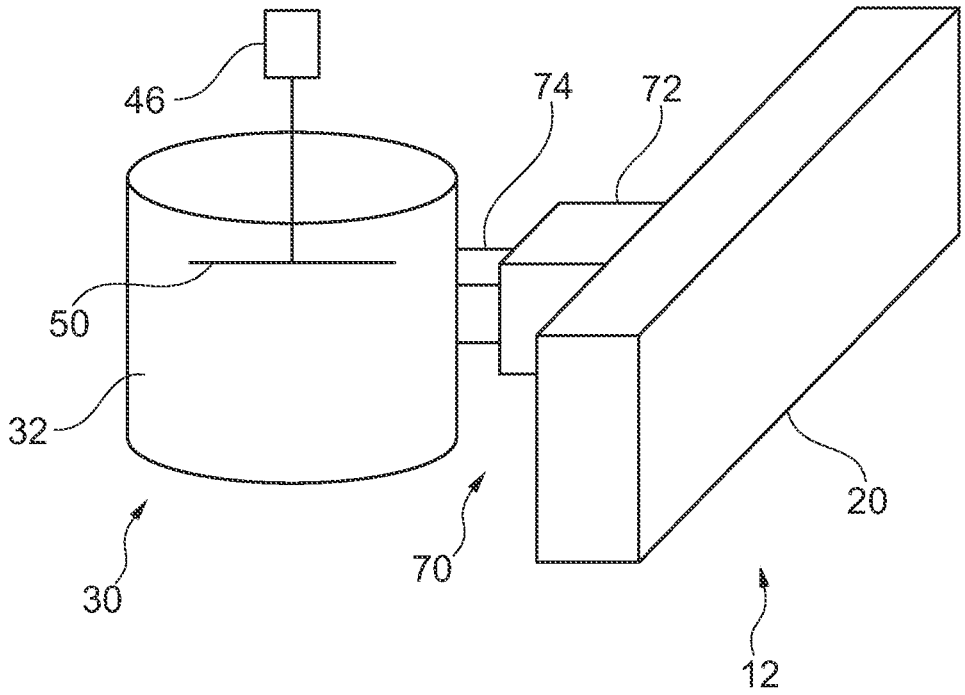
FIG. 6 shows a schematic three-dimensional view of a parallel resonator according to another specific embodiment of the invention.

FIG. 6 shows a schematic view of a parallel resonator 30, which is coupled via an input aperture 70 with the waveguide 20 of the waveguide busbar 12. The parallel resonator 30 is mounted on the waveguide busbar 12 at the side above the input aperture 70. To this end, a first connecting waveguide 72, which is connected to a second connecting waveguide 74 having a smaller diameter, the latter in turn being connected to the container of the parallel resonator 30, is therefore mounted on the waveguide 20.

The parallel resonator 30 from FIG. 6 has a cylindrical and/or barrel-shaped container, whose axis runs essentially at a right angle to the direction of extent of the waveguide 20. An adjustment mechanism having a slide 50 or a flap 50 having an actuator 46, which may be designed thermomechanically and/or electromechanically, as indicated above, is situated in the resonant volume 32.

In addition, it should be pointed out that "comprising" does not preclude any other elements or steps and "a/an" or "one" does not preclude a plurality. Furthermore, it should be pointed out that features or steps described with reference to one of the above exemplary embodiments may also be used in combination with other features or steps of other exemplary embodiments described above. The reference numerals in the claims are not to be regarded as a restriction.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A waveguide busbar configured to convert a plurality of high-frequency input signals into a high-frequency output signal, the waveguide busbar comprising:
- a waveguide;
- a plurality of input ports, which are arranged along the waveguide, such that each input port is configured to receive a high-frequency input signal;
- an output port on the waveguide configured to deliver the high-frequency output signal;
- a parallel resonator connected to the waveguide busbar between two input ports;
- wherein the parallel resonator is configured with a mechanically adjustable volume with which a phase relation of the waveguide between the two input ports is adjustable.

2. The waveguide busbar according to claim 1, wherein the parallel resonator comprises an actuator configured to alter the volume of the parallel resonator.

3. The waveguide busbar according to claim 2, wherein the actuator comprises a thermomechanical actuator.

4. The waveguide busbar according to claim 3, wherein the thermomechanical actuator is configured to change the volume of the parallel resonator so that a change in the phase relation of the waveguide because of expansion of the waveguide due to a change in temperature is reduced by the parallel resonator.

5. The waveguide busbar according to claim 2, wherein the actuator comprises an electromechanical actuator.

6. The waveguide busbar according to claim 5, further comprising:
- an electronic controller, which is configured to control the electromechanical actuator, such that a change in the phase relation of the waveguide because of an expansion of the waveguide due to a change in temperature is reduced by the parallel resonator.

7. The waveguide busbar according to claim 1, wherein the parallel resonator has a resonant volume of a variable length.

8. The waveguide busbar according to claim 1, wherein the parallel resonator comprises a movable slide element in a hollow space.

9. The waveguide busbar according to claim 1, further comprising:
- a plurality of parallel resonators.

10. The waveguide busbar according to claim 9, wherein at least one of the plurality of parallel resonators is connected to the waveguide between two neighboring input ports.

11. The waveguide busbar according to claim 9, wherein at least two parallel resonators are connected to the waveguide between two neighboring input ports.

12. The waveguide busbar according to claim 1, further comprising:
- a plurality of connecting pieces, which are connected to the input ports; wherein phase lengths of waveguide sections between the two input ports and phase lengths of the connecting pieces are set for predefined frequencies of the high-frequency output signals.

13. The waveguide busbar according to claim 1, wherein a resonant range of the parallel resonator is set for a pass band of the waveguide busbar.

14. An output multiplexer, comprising:
- a waveguide busbar configured to convert a plurality of high-frequency input signals into a high-frequency output signal, the waveguide busbar comprising
  - a waveguide;
  - a plurality of input ports, which are arranged along the waveguide, such that each input port is configured to receive a high-frequency input signal;
  - an output port on the waveguide configured to deliver the high-frequency output signal;
  - a parallel resonator connected to the waveguide busbar between two input ports;
  - wherein the parallel resonator is configured with a mechanically adjustable volume with which a phase relation of the waveguide between the two input ports is adjustable;
- a plurality of channel filters which are connected to the input ports of the waveguide busbar.

15. A communication satellite, comprising:
- an output multiplexer, comprising
  - a waveguide busbar configured to convert a plurality of high-frequency input signals into a high-frequency output signal, the waveguide busbar comprising
    - a waveguide;
    - a plurality of input ports, which are arranged along the waveguide, such that each input port is configured to receive a high-frequency input signal;
    - an output port on the waveguide configured to deliver the high-frequency output signal;
    - a parallel resonator connected to the waveguide busbar between two input ports;

wherein the parallel resonator is configured with a mechanically adjustable volume with which a phase relation of the waveguide between the two input ports is adjustable;

a plurality of channel filters which are connected to the input ports of the waveguide busbar.

* * * * *